US005475967A

United States Patent [19]

Levi

[11] Patent Number: 5,475,967

[45] Date of Patent: Dec. 19, 1995

[54] APPARATUS AND METHOD FOR SLITTING BOXES

[76] Inventor: Hans L. Levi, 400 Boylston Ave. East, Seattle, Wash. 98102

[21] Appl. No.: 410,851

[22] Filed: Mar. 28, 1995

[51] Int. Cl.[6] ..... B65B 43/26

[52] U.S. Cl. ..... 53/492; 53/381.2; 83/446

[58] Field of Search ..... 53/492, 381.2, 53/382.1; 83/54, 444, 449, 446, 946; 414/412

[56] References Cited

U.S. PATENT DOCUMENTS

| | | | |
|---|---|---|---|
| 3,481,097 | 12/1969 | Iserman | 53/382.1 |
| 3,563,121 | 2/1971 | Furman | 83/449 |
| 3,889,442 | 6/1975 | Grahn et al. | 53/381.2 |
| 4,373,563 | 2/1983 | Kenyon | 83/446 |
| 4,840,011 | 6/1989 | Muramatsu et al. | 53/381 R |
| 4,843,801 | 7/1989 | Roncero | 53/382.1 |
| 4,850,257 | 7/1989 | Mohr | 83/446 |
| 5,048,267 | 9/1991 | Kudo et al. | 53/492 |
| 5,074,097 | 12/1991 | Hull | 53/381.2 |
| 5,101,703 | 4/1992 | Tanaka et al. | 83/880 |
| 5,201,788 | 4/1993 | Le Naour | 53/468 |
| 5,275,524 | 1/1994 | Ishiwata | 414/412 |

*Primary Examiner*—John Sipos
*Assistant Examiner*—Gene L. Kim
*Attorney, Agent, or Firm*—Richard S. Roberts

[57] ABSTRACT

An apparatus and method for cutting open a sealed box. A box typically has several of planar panels having a thickness and which panels meet at edges to define a box length, width and height and a central cavity. A box is conveyed to a cutting station where it is urged against a rotating blade which cuts through a box edge and pierces parallel to the plane of and into the thickness of one of the planar panels without entering the central cavity. The apparatus and method are useful for slitting boxes containing rectangular objects without marring the box contents. The apparatus is particularly useful for cutting open boxes containing books or the like, without damaging the box contents.

20 Claims, 3 Drawing Sheets

APPARATUS AND METHOD FOR SLITTING BOXES

BACKGROUND OF THE INVENTION

1. Field of the Invention

The present invention relates to an apparatus and method for slitting boxes and more particularly, for cutting boxes containing rectangular objects without marring the box contents. The apparatus is particularly useful for cutting open boxes containing books and the like, without damaging the box contents.

2. Description of the Prior Art

It is long been desired in the art to be able to safely cut open boxes which package rectangular materials without damaging the contents. In the book publishing industry, sample books are often sent to consumers subject to their personal satisfaction and approval. As a consequence, such books are very often returned and must be processed by the publisher. Processing includes opening packaging materials and examining the returned items for damage. Books which are in excellent condition are available for resale, however, damaged books must be destroyed at great economic loss. Current practice in the art is for book return packages to be opened manually. Such labor intensive processing is very costly and one of the causes of book damage is human error in the opening process. The prior art has attempted to alleviate this problem by providing automated cutting equipment to open the returned packages. This has led to still further problems. Current box cutting machinery have blades which attack the box either perpendicularly or at an oblique angle to the plane of the book contents. In this regard, U.S. Pat. No. 5,048,267 teaches one cutting method for opening a rectangular package by forming a space between the package and the contents, cutting an edge, inserting a backplate and cutting the packaging on the surface of the backplate. This requires excessive manipulation steps. U.S. Pat. No. 5,074,097 shows a means for removing box tops by means of a cutting fluid under pressure. Such would not be useful for contents which must be kept dry. U.S. Pat. No. 5,275,524 shows an apparatus for cutting packaging material for cans by deforming the packing under vacuum conditions prior to cutting. This apparatus would not be useful for rectangular packaged items. U.S. Pat. No. 5,101,703 shows a box cutting method and apparatus using rotary knives disposed at an angle of approximately 45° to the box side walls. Such would not accommodate boxes of varying sizes. U.S. Pat. No. 4,840,001 discloses a device for cutting only the tape supporting a box without cutting the box ends itself. This device would be inappropriate for boxes which are sealed with glue. U.S. Pat. No. 5,201,788 pertains to a device for cutting off the upper portion of a bottle and does not suggest usefulness for cutting boxes.

Since book packages are not of uniform size, the package presented to cutting machinery is often slashed too deeply thus irreparably damaging the contents. It has been found that by providing a box cutting apparatus with a blade which attacks the box parallel to and spaced from the plane of the book contents, that cutting damage is greatly reduced. If a blade penetrates the box at a depth greater than actually desired, the blade merely passes along side the book and does not damage it.

Typically boxes which are to be opened are constructed of corrugated paperboard. It has been found that during the shipping process, the corrugated materials often becomes warped. While the major panels of the corrugated materials were originally parallel and perpendicular to the planes of the book contents, the handling process often causes bending, twisting and or other distortions such that they are no longer perfectly square with the book planes. Thus, when a blade confronts the box parallel to the largest panel plane, there is still a risk of the box being improperly cut. However, corrugated boxes are extraordinarily strong and resistant to warping at its edges, corners and folds. The invention therefore provides an apparatus and method of cutting boxes parallel to and spaced from the plane of book contents and wherein the cut is made along a folded edge of the box from one corner to an adjacent corner of the box. It has now been unexpectedly found that when a box is cut in such a fashion, that boxes are reliably opened without damaging the contents.

SUMMARY OF THE INVENTION

The invention provides an apparatus for cutting open a sealed box, which box has a plurality of planar panels each having a thickness, which panels meet at a plurality of edges to define a box length, width and height and a central cavity, which comprises means for conveying a box to a cutting station; and a cutting station which comprises means for causing a rotating blade to cut through an edge and pierce parallel to the plane of and into the thickness of one of the planar panels without entering the central cavity; and means for urging the box against the rotating blade.

The invention also provides a method for cutting open a sealed box, which box has a plurality of planar panels each having a thickness, which panels meet at a plurality of edges to define a box length, width and height and a central cavity, which method comprises conveying a box to a cutting station and urging the box against a rotating blade at the cutting station by causing the rotating blade to cut through an edge and pierce parallel to the plane of and into the thickness of one of the planar panels without entering the central cavity.

DETAILED DESCRIPTION OF THE PREFERRED EMBODIMENT

Figure 1:
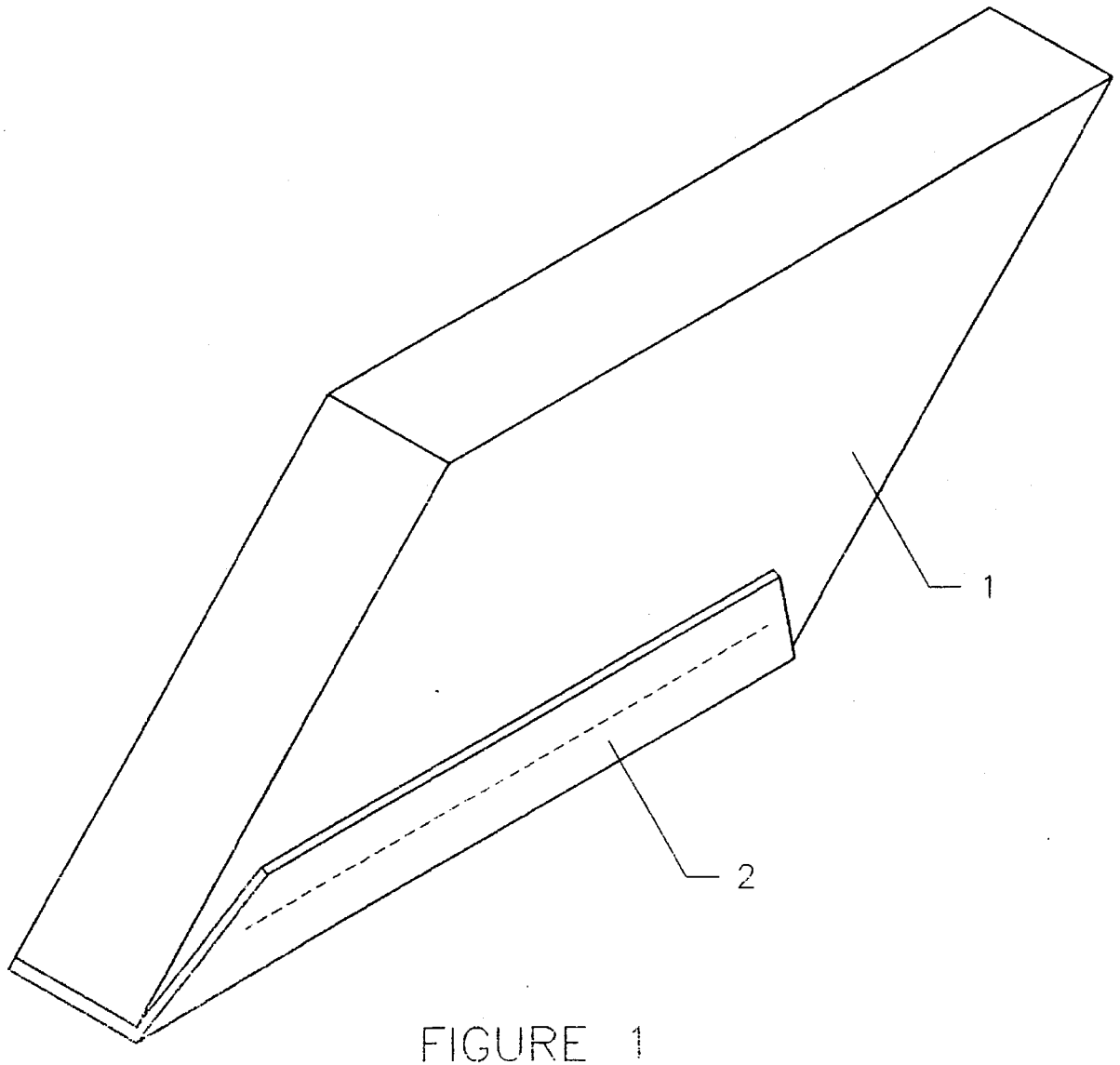
FIG. 1 shows a perspective view of a typical book packaging box having a sealing flap.
Figure 2:
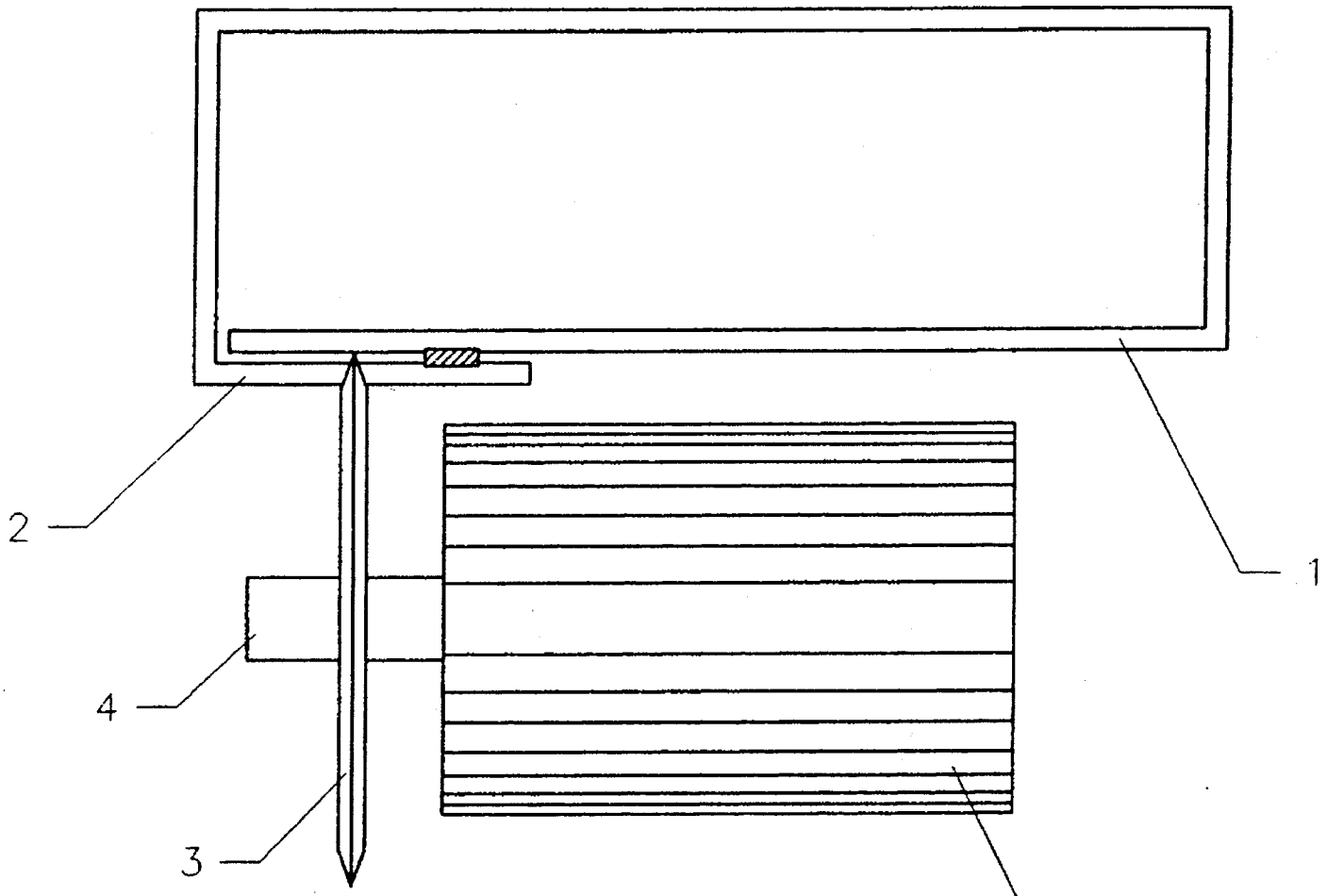
PRIOR ART FIGURE 2
FIG. 2 shows a schematic view of a typical prior art device showing a blade entering a box which may cut the contents.
Figure 3:
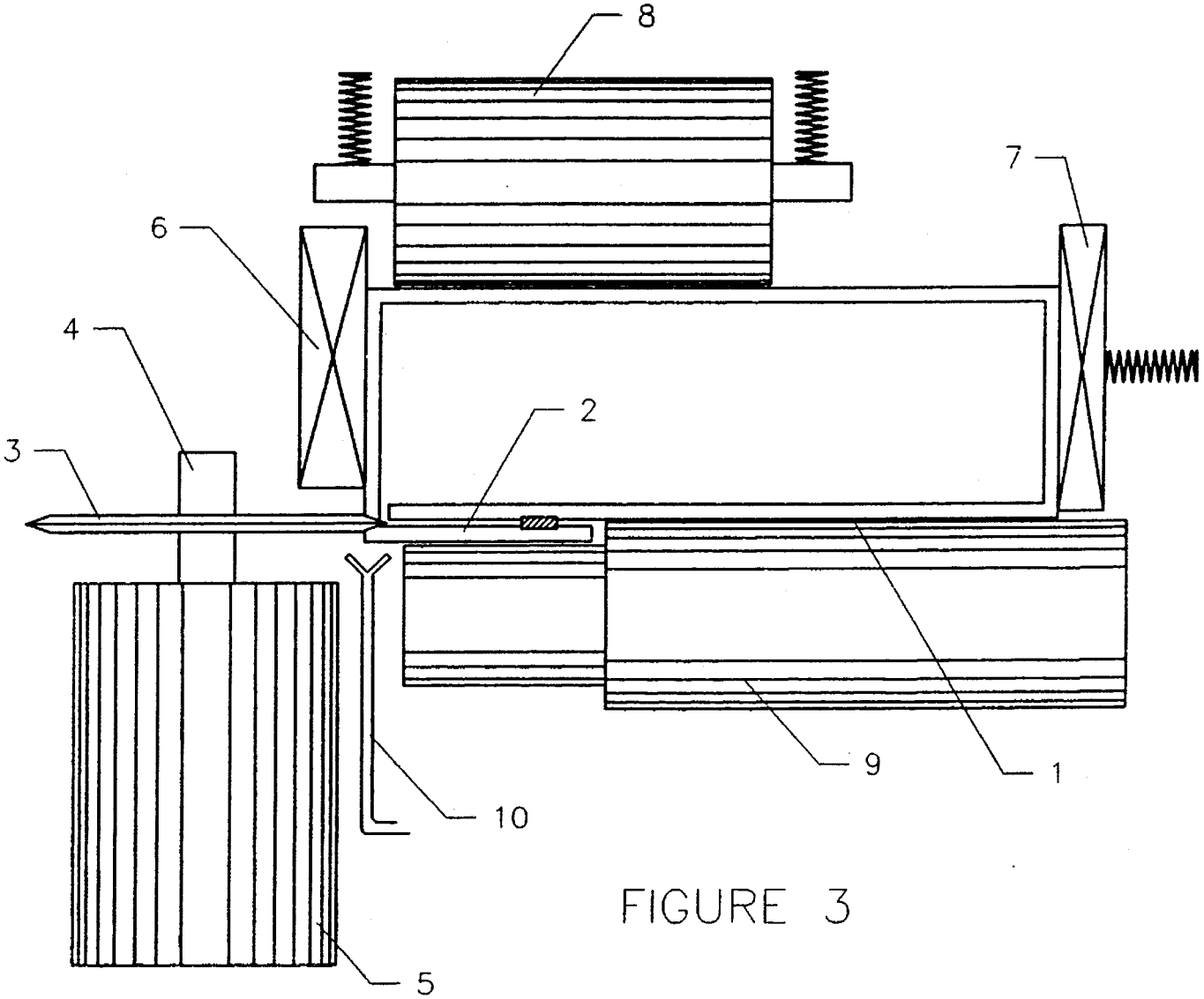
FIG. 3 is a schematic representation of an apparatus according to the invention.

FIG. 1 shows a typical packaging box which is useful for mailing books. Almost all books mailers in use today are of the wrap around type which include a glue flap 2 which is wrapped around the bottom panel 1 of the carton and glued to the bottom panel to secure the contents of the package. FIG. 2 shows a schematic representation of existing semi-automatic cutting device which conveys the mailer with the glue flap down over a knife blade 3 driven by motor 5 via shaft 4. The knife blade moves at a speed higher than the traveling speed of the carton and is intended to cut perpendicularly through the glue flaps without penetrating through the bottom panel of the carton and possibly damaging the book contained in the carton. Because of the needed accuracy of the cutting depth combined with the frequent warp of the carton along the glue flap, this cut is frequently imperfect. Portions of the cardboard material often remain connected and operators must manually complete the cutting procedure. FIG. 3 shows an apparatus according to the present invention. Shown is a box having a bottom panel 1 and glue flap 2 wrapped around the carton and glued parallel to the plane of bottom panel 1. Boxes are positioned by conveyor rollers or belts 9 to a cutting station. The carton is guided along a side stop 6 which assures consistency of cut depth once the cutting blade has been adjusted to the desired depth. A spring loaded back stop 7 presses the box along side stop 6 during cutting. Spring loaded top rollers 8 assure flat and tight compacting of the box to conveyor rollers 9 so that the vertical height of the cut remains constant. As shown in FIG. 3, a motor 5 drives shaft 4 and cutting blade 3. The shaft is positioned vertically as shown. A knife or saw blade, such as a carbide tipped knife or saw blade of suitable cutting quality is mounted horizontally rather than vertically with respect to the largest plane of the book, the plane of the largest box panel and glue flap 2. This arrangement allows variations in the cut depth because the bottom panel shields the contents from the cutting knife. Optionally, the cutting station may have a vacuum line 10 which is suitable for removing dust resulting from the cutting.

In operation, a box is positioned by conveyor rollers 9 to a cutting station where it is guided along a side stop 6 by spring loaded back stop 7 which presses the box along the side stop during cutting. Spring loaded top rollers 8 press the box against conveyor rollers 9. Motor 5 drives vertical shaft 4 and horizontal cutting blade 3. The blade cuts a folded edge of the end glue flap and pierces parallel to the plane of and into the thickness of one of the planar panels without entering the central cavity. As shown in FIG. 3, blade 3 enters the carton parallel to and through either glue flap 2, bottom panel 1 or between the glue flap and the bottom panel. This configuration allows cutting boxes of a wide variety of dimensions since the top rollers self-correct for box height and for any warping of the bottom panel. The back stop and side stop self-correct for box width any side panel warping. This provides a 90° edge for cutting at all times and allows the blade to traverse cleanly parallel to the plane of the bottom panel and into the thickness of the glue flap or bottom panel. Since the blade is positioned such that it never enters the central cavity of the box, it can cut deeply into the bottom panel or glue flap thickness and never damage the box contents.

What is claimed is:

1. An apparatus for cutting open a sealed box, which box has a plurality of planar panels each having a thickness, which panels meet at a plurality of edges to define a box length, width and height and a central cavity, which comprises means for conveying a box to a cutting station; and a cutting station which comprises means for causing a rotating blade to cut into and along the length of an edge and pierce parallel to the plane of and into the thickness of one of the planar panels without entering the central cavity; and means for urging the box against the rotating blade.

2. The apparatus of claim 1 wherein the means for conveying a box to the cutting station comprises a conveyor belt.

3. The apparatus of claim 1 wherein the means for conveying a box to the cutting station comprises at least two conveyor belts having different relative thicknesses.

4. The apparatus of claim 1 wherein the means for conveying a box to the cutting station comprises a plurality of rollers.

5. The apparatus of claim 1 wherein the means for conveying a box to the cutting station comprises a plurality of rollers having different diameters.

6. The apparatus of claim 1 wherein the blade comprises a knife or a saw.

7. The apparatus of claim 1 wherein the blade comprises a carbide tipped knife or a carbide tipped saw.

8. The apparatus of claim 1 wherein the blade rotates in a substantially horizontal orientation.

9. The apparatus of claim 1 wherein the blade is fixed to a substantially vertical shaft which shaft rotates by means of a motor.

10. The apparatus of claim 1 wherein the means for urging the box against the rotating blade comprises a spring loaded back stop.

11. The apparatus of claim 10 wherein the spring loaded backstop urges the box against the rotating blade and a side stop.

12. The apparatus of claim 1 wherein the cutting station comprises a spring loaded top roller.

13. The apparatus of claim 1 wherein the cutting station comprises a spring loaded top roller which top roller urges the box against the conveying means.

14. The apparatus of claim 1 wherein the cutting station further comprises dust removal vacuum means.

15. The apparatus of claim 1 wherein the means for conveying a box to the cutting station comprises a conveyor belt or a plurality of rollers; wherein the blade comprises a knife or a saw; wherein the blade is fixed to a substantially vertical shaft which rotates by means of a motor such that the blade rotates in a substantially horizontal orientation; wherein the means for urging the box against the rotating blade comprises a spring loaded back stop which urges the box against the rotating blade and a side stop; wherein the cutting station comprises a spring loaded top roller which urges the box against the conveying means.

16. An method for cutting open a sealed box, which box has a plurality of planar panels each having a thickness, which panels meet at a plurality of edges to define a box length, width and height and a central cavity, which method comprises conveying a box to a cutting station and urging the box against a rotating blade at the cutting station and causing the rotating blade to cut into and along the edge of an edge and pierce parallel to the plane of and into the thickness of one of the planar panels without entering the central cavity.

17. The method of claim 16 wherein the box is conveyed to the cutting station by means of a conveyor belt or a plurality of rollers; wherein the blade comprises a knife or a saw; wherein the blade is fixed to a substantially vertical shaft which rotates by means of a motor such that the blade rotates in a substantially horizontal orientation; wherein the urging of the box against the rotating blade is effected by a spring loaded back stop which urges the box against the rotating blade and a side stop; and wherein the box is urged against the conveying means at the cutting station by a spring loaded top roller.

18. The method of claim 16 wherein dust is removed from the cutting station by vacuum means.

19. The method of claim 16 wherein the box has a glue flap fixed to one of the planar panels and the blade cuts through the glue flap in a direction parallel to the plane of the glue flap.

20. The method of claim 16 wherein one of the planar panel having the greatest length and the greatest width is defined as the bottom panel and wherein the box has a glue flap fixed to the bottom panel and wherein the blade cuts through the glue flap in a direction parallel to the plane of the glue flap such that the blade cuts either into the thickness of the bottom panel or into the thickness of the glue flap or between the bottom panel and the glue flap, without entering the central cavity.

* * * * *